US009726068B2

(12) United States Patent
Murai et al.

(10) Patent No.: US 9,726,068 B2
(45) Date of Patent: Aug. 8, 2017

(54) COOLING DEVICE FOR INTERNAL COMBUSTION ENGINE AND CONTROL METHOD FOR COOLING DEVICE

(71) Applicant: Hitachi Automotive Systems, Ltd., Hitachinaka-shi, Ibaraki (JP)

(72) Inventors: Atsushi Murai, Isesaki (JP); Tomoyuki Murakami, Isesaki (JP); Shigeyuki Sakaguchi, Isesaki (JP); Yuichi Toyama, Isesaki (JP); Masahiko Watanabe, Isesaki (JP); Hideaki Nakamura, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/125,336

(22) PCT Filed: Sep. 18, 2014

(86) PCT No.: PCT/JP2014/074704
§ 371 (c)(1),
(2) Date: Sep. 12, 2016

(87) PCT Pub. No.: WO2015/136747
PCT Pub. Date: Sep. 17, 2015

(65) Prior Publication Data

US 2017/0107891 A1 Apr. 20, 2017

(30) Foreign Application Priority Data

Mar. 12, 2014 (JP) ..... 2014-048707

(51) Int. Cl.
*F01P 7/14* (2006.01)
*F01P 7/16* (2006.01)
(Continued)

(52) U.S. Cl.
CPC *F01P 7/16* (2013.01); *F01P 3/02* (2013.01); *F01P 5/10* (2013.01); *F01P 7/14* (2013.01);
(Continued)

(58) Field of Classification Search
CPC ..... F01P 7/16; F01P 3/02; F01P 5/10; F01P 7/14; F01P 2007/143; F01P 2007/146; F01P 2003/024; F01P 11/04
See application file for complete search history.

(56) References Cited

U.S. PATENT DOCUMENTS

2012/0210954 A1 8/2012 Nishikawa et al.
2013/0221116 A1* 8/2013 Tsuchiya ..... F01P 7/14 236/34.5

(Continued)

FOREIGN PATENT DOCUMENTS

DE 10 2012 202 531 A1 8/2012
DE 11 2014 000 931 T5 11/2015

(Continued)

OTHER PUBLICATIONS

International Search Report (PCT/ISA/210) issued in PCT Application No. PCT/JP2014/074704 dated Dec. 16, 2014 with English translation (6 pages).

(Continued)

*Primary Examiner* — Jacob Amick
(74) *Attorney, Agent, or Firm* — Crowell & Moring LLP

(57) ABSTRACT

The present invention relates to a cooling device and a control method for the same. This cooling device includes: a first cooling liquid line routed by way of a cylinder head and a radiator; a second cooling liquid line routed by way of a cylinder block while bypassing the radiator; an electric flow rate control valve whose inlet is connected to the first and second cooling liquid lines, and whose outlet is connected to the intake side of an electric water pump; and a
(Continued)

bypass line that branches off from the first cooling liquid line at a point between the cylinder head and the radiator and that joins to the outlet of the flow rate control valve while bypassing the radiator. A control unit controls the flow rate control valve according to the temperature of the cylinder head and the temperature of the cylinder block.

14 Claims, 14 Drawing Sheets

(51) Int. Cl.
*F01P 3/02* (2006.01)
*F01P 5/10* (2006.01)

(52) U.S. Cl.
CPC ... *F01P 2003/024* (2013.01); *F01P 2007/146* (2013.01)

(56) References Cited

U.S. PATENT DOCUMENTS

| | | | | |
|---|---|---|---|---|
| 2014/0283765 | A1* | 9/2014 | Naito | F01P 3/12 123/41.09 |
| 2015/0377114 | A1 | 12/2015 | Matsumoto et al. | |

FOREIGN PATENT DOCUMENTS

| | | | |
|---|---|---|---|
| EP | 1 522 689 | B1 | 9/2011 |
| JP | 2003-293767 | A | 10/2003 |
| JP | 4196802 | B2 | 12/2008 |
| JP | 2009-68363 | A | 4/2009 |
| JP | 2012-184693 | A | 9/2012 |
| JP | 2013-238189 | A | 11/2013 |
| JP | 2014-145326 | A | 8/2014 |
| WO | WO 2014/129145 | A1 | 8/2014 |

OTHER PUBLICATIONS

Japanese-language Written Opinion (PCT/ISA/237) issued in PCT Application No. PCT/JP2014/074704 dated Dec. 16, 2014 with English translation (16 pages).

International Preliminary Report on Patentability (PCT/IB/326, PCT/IB/338 & PCT/IB/373) issued in PCT Application No. PCT/JP2014/074704 dated Sep. 22, 2016, including English translation of document C2 (Japanese-language Written Opinion (PCT/ISA/237)) previously filed on Sep. 12, 2016 (15 pages).

German Office Action issued in counterpart German Application No. 11 2014 006 448.3 dated Jan. 3, 2017 with partial English-language translation (eleven (11) pages).

* cited by examiner

COOLING DEVICE FOR INTERNAL COMBUSTION ENGINE AND CONTROL METHOD FOR COOLING DEVICE

TECHNICAL FIELD

The present invention relates to a cooling device for letting a water pump circulate cooling liquid in an internal combustion engine, and a control method for the cooling device.

BACKGROUND ART

Patent Document 1 discloses a cooling water circuit system including a radiator cooling water circuit, a radiator bypass circuit, a heat exchanger, a radiator downstream passage, and flow rate adjusting means. Through the radiator cooling water circuit, the cooling water flows by way of a radiator. The radiator bypass circuit bypasses the radiator. The heat exchanger is disposed in the radiator bypass circuit so as to exchange heat between the cooling water and hydraulic oil of an automatic transmission of an engine. Through the radiator downstream passage, which is connected to the radiator cooling water circuit at a downstream side of the radiator and an upstream side of the heat exchanger, the cooling water having passed through the radiator flows into the heat exchanger. The flow rate adjusting means is for adjusting a flow ratio between the cooling water flowing through the radiator bypass circuit into the heat exchanger and the cooling water flowing through the radiator downstream passage into the heat exchanger, and is disposed at a connection between the radiator bypass circuit and the radiator downstream passage.

REFERENCE DOCUMENT LIST

Patent Document

Patent Document 1: Japanese Patent No. 4196802

SUMMARY OF THE INVENTION

Problems to be Solved by the Invention

While an internal combustion engine is in a warm-up operation after the start up, quickly increasing the temperature of the cylinder head or quickly increasing the combustion temperature can improve combustibility, and thus fuel economy, exhaust gas properties and the like of the internal combustion engine.

After the completion of the warm-up of the internal combustion engine, reducing the temperature rise in the cylinder head can prevent or reduce the occurrence of knocking, while increasing the temperature of the cylinder block can reduce friction, and thus improve fuel economy.

In view of the above, an object of the present invention is to provide a cooling device for an internal combustion engine and a control method for the cooling device which improves the temperature controllability of the cylinder head and the cylinder block to improve fuel economy of the internal combustion engine.

Means for Solving the Problems

To achieve the above, a cooling device according to the present invention includes a water pump, a first cooling liquid line, a second cooling liquid line, an electric flow rate control valve, and a bypass line. The water pump circulates cooling liquid in the internal combustion engine. The first cooling liquid line is routed by way of a radiator and a cylinder head of the internal combustion engine. The second cooling liquid line is routed by way of a cylinder block of the internal combustion engine while bypassing the radiator. An inlet of the electric flow rate control valve is connected to the first cooling liquid line and the second cooling liquid line, and an outlet is connected to an intake side of the water pump. The bypass line branches off from the first cooling liquid line at a point between the cylinder head and the radiator and joins to the outlet of the flow rate control valve while bypassing the radiator.

In a control method for a cooling device according to the present invention, the control device includes a water pump, a first cooling liquid line, a second cooling liquid line, an electric flow rate control valve, and a bypass line. The water pump circulates cooling liquid in the internal combustion engine. The first cooling liquid line is routed by way of a radiator and a cylinder head of the internal combustion engine. The second cooling liquid line is routed by way of a cylinder block of the internal combustion engine while bypassing the radiator. An inlet of the electric flow rate control valve is connected to the first cooling liquid line and the second cooling liquid line, and an outlet is connected to an intake side of the water pump. The bypass line branches off from the first cooling liquid line at a point between the cylinder head and the radiator and joins to the outlet of the flow rate control valve while bypassing the radiator. The control method includes a step of measuring a temperature of the cooling liquid at an outlet of the cylinder head, a step of measuring a temperature of the cooling liquid at an outlet of the cylinder block, and a step of controlling the flow rate control valve on the basis of a temperature of the cooling liquid at an outlet of the cylinder head and a temperature of the cooling liquid at an outlet of the cylinder block.

Effects of the Invention

According to the invention described above, temperature controllability of the cylinder head and the cylinder block is improved, and thus fuel economy of the internal combustion engine can be improved.

MODE FOR CARRYING OUT THE INVENTION

Hereinafter, an embodiment of the present invention will be described.

Figure 1:
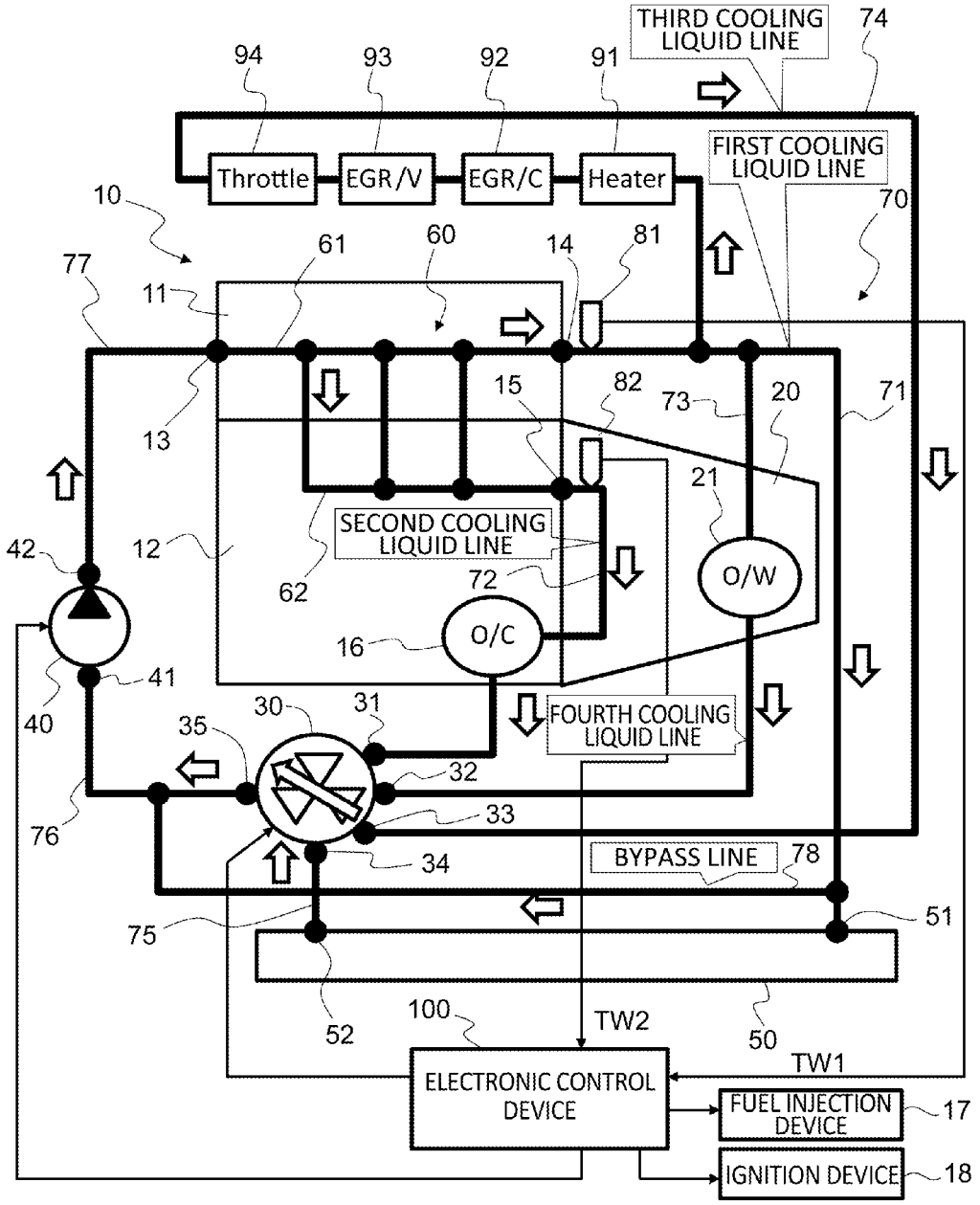
FIG. 1 is a schematic view of a cooling device for an internal combustion engine according to an embodiment of the present invention.

FIG. 1 illustrates the configuration of an example of a cooling device according to the present invention.

A vehicle internal combustion engine 10 has a cylinder head 11 and a cylinder block 12. A transmission 20, which is an example of a power transmission device, is coupled to the output shaft of internal combustion engine 10. The output of transmission 20 is transmitted to the unillustrated drive wheels.

Internal combustion engine 10 is cooled by a water-cooled cooling device which circulates cooling water (cooling liquid). The cooling device includes a flow rate control valve 30 actuated by an electric actuator, an electric water pump 40 driven by a motor, a radiator 50, a cooling water passage 60 provided in internal combustion engine 10 and pipes 70 connecting these components.

Cylinder head 11 of internal combustion engine 10 has a cooling water inlet 13 at one end in the cylinder arrangement direction, and a cooling water outlet 14 at the other end in the cylinder arrangement direction. In cylinder head 11, there is provided a cooling water passage 61 extending therein so as to connect cooling water inlet 13 to cooling water outlet 14.

Cylinder block 12 of internal combustion engine 60 has a cooling water outlet 15. In cylinder block 12, there is provided a cooling water passage 62 branching off from cooling water passage 61 and entering cylinder block 12 so as to extend therein and to be connected to cooling water outlet 15. Cooling water outlet 15 is provided to cylinder block 12 at an end, on the same side where cooling water outlet 14 is provided, in the cylinder arrangement direction.

In the cooling device exemplified in FIG. 1, the cooling water is supplied through cylinder head 11 to cylinder block 12. The cooling water having passed through only cylinder head 11 is discharged from cooling water outlet 14. The cooling water having passed through cylinder head 11 and then through cylinder block 12 is discharged from cooling water outlet 15.

To cooling water outlet 14 of cylinder head 11, one end of a first cooling water pipe 71 is connected, while the other end thereof is connected to a cooling water inlet 51 of radiator 50.

To cooling water outlet 15 of cylinder block 12, one end of a second cooling water pipe 72 is connected, while the other end thereof is connected to a first inlet port 31 among four inlet ports (flow inlet hole) 31 to 34 of flow rate control valve 30.

In the middle of second cooling water pipe 72, there is provided an oil cooler 16 which cools lubricant oil for internal combustion engine 10. Oil cooler 16 exchanges heat between the cooling water flowing through second cooling water pipe 72 and the lubricant oil for internal combustion engine 10.

A third cooling water pipe 73 is connected at one end to first cooling water pipe 71 and at the other end to second inlet port 32 of flow rate control valve 30. In the middle of third cooling water pipe 73, there is provided an oil warmer 21 which heats hydraulic oil of transmission 20.

Oil warmer 21 exchanges heat between the cooling water flowing through third cooling water pipe 73 and the hydraulic oil of transmission 20. In other words, third cooling water pipe 73 allows the cooling water having passed through cylinder head 11 to be partially diverted and introduced into oil warmer 21 so as to heat the hydraulic oil in oil warmer 21.

A fourth cooling water pipe 74 is connected at one end to first cooling water pipe 71, and at the other end to third inlet port 33 of flow rate control valve 30.

Various heat exchanging devices are disposed on fourth cooling water pipe 74.

The heat exchanging devices described above are, in the order from upstream to downstream, a heater core 91 for vehicle air heating, a water-cooled EGR cooler 92, an exhaust gas recirculation control valve 93 and a throttle valve 94. EGR cooler 92 and exhaust gas recirculation control valve 93 for regulating an exhaust gas recirculation rate constitute an exhaust gas recirculation device of internal combustion engine 10. Throttle valve 94 regulates the amount of air intake in internal combustion engine 10.

Heater core 91 is a device for exchanging heat between the cooling water in fourth cooling water pipe 74 and air for conditioning so as to heat the air for conditioning.

EGR cooler 92 exchanges heat between the cooling water in fourth cooling water pipe 74 and the exhaust gas recirculated into an intake system of internal combustion engine 10 by the exhaust gas recirculation device so as to lower the temperature of the recirculated exhaust gas.

Exhaust gas recirculation control valve 93 and throttle valve 94 are heated by exchanging heat with the cooling water in fourth cooling water pipe 74. This configuration prevents the freeze of moisture in the exhaust gas around exhaust gas recirculation control valve 93 as well as moisture in the intake air around throttle valve 94.

As described above, fourth cooling water pipe 74 allows the cooling water having passed through cylinder head 11 to be partially diverted and introduced into heater core 91, EGR cooler 92, exhaust gas recirculation control valve 93 and throttle valve 94 so as to exchange heat therewith.

A fifth cooling water pipe 75 is connected at one end to a cooling water outlet 52 of radiator 50, and at the other end to fourth inlet port 34 of flow rate control valve 30.

Flow rate control valve 30 has an outlet port (flow outlet hole) 35. A sixth cooling water pipe 76 is connected at one end to outlet port 35, and at the other end to an intake port 41 of water pump 40.

A seventh cooling water pipe 77 is connected at one end to a discharge port 42 of water pump 40, and at the other end to cooling water inlet 13 of cylinder head 11.

An eighth cooling water pipe 78 is connected at one end to first cooling water pipe 71, and at the other end to sixth cooling water pipe 76. Specifically, in first cooling water pipe 71, the point where eighth cooling water pipe 78 is connected is located downstream to the point connected to third cooling water pipe 73 and downstream to the point connected to fourth cooling water pipe 74.

As described above, flow rate control valve 30 includes four inlet ports (flow inlet holes) 31 to 34 and outlet port (flow outlet hole) 35. To inlet ports 31 to 34, cooling water pipes 72, 73, 74 and 75 are respectively connected, while sixth cooling water pipe 76 is connected to outlet port 35.

Flow rate control valve 30 is, for example, a rotational flow channel switching valve that includes a stator having multiple ports 31 to 35 formed therein, and a rotor having flow channels therein and being fitted in the stator. Flow rate control valve 30 connects the flow channels of the rotor to ports 31 to 35 of the rotor in accordance with the angular position of the rotor changed by the electric actuator such as an electric motor.

In rotational flow rate control valve 30, the opening area ratio of four inlet ports 31 to 34 changes in accordance with the rotor angle. The flow channels and the like in the rotor are configured appropriately so as to make it possible to desirably control this opening area ratio by changing the rotor angle.

In the above configuration, cooling water passage 61 and first cooling water pipe 71 constitute a first cooling liquid line, which is routed by way of cylinder head 11 and radiator 50.

Cooling water passage 62 and second cooling water pipe 72 constitute a second cooling liquid line, which is routed by way of cylinder block 12 while bypassing radiator 50.

Cooling water passage 61 and fourth cooling water pipe 74 constitute a third cooling liquid line, which is routed by way of cylinder head 11 and heater core 91 while bypassing radiator 50.

Cooling water passage 61 and third cooling water pipe 73 constitute a fourth cooling liquid line, which is routed by way of cylinder head 11 and oil warmer 21 of transmission 20 while bypassing radiator 50.

In addition, eighth cooling water pipe 78 serves as a bypass line that branches off from the first cooling liquid line at a point between cylinder head 11 and radiator 50 and that joins to an outlet of flow rate control valve 30 while bypassing radiator 50.

In other words, flow rate control valve 30 is a flow channel switching mechanism whose inlet is connected to the first to fourth cooling liquid lines, and whose outlet is connected to the intake side of water pump 40. Flow rate control valve 30 controls the supply rate of the cooling water to the first to fourth cooling liquid lines by regulating the opening area of the outlets of the first to fourth cooling liquid lines.

Figure 5:
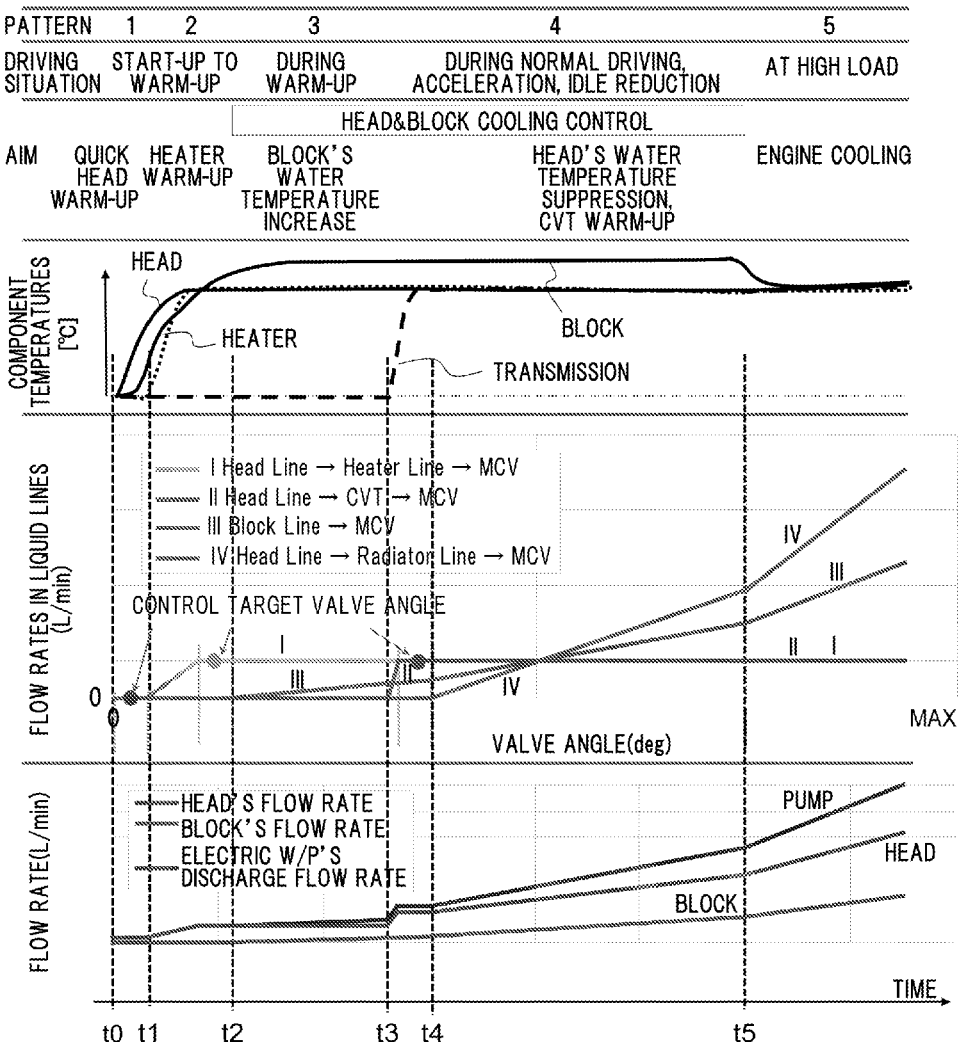
FIG. 5 is a time chart exemplifying switching control of the flow rate control valve according to the embodiment of the present invention.

Flow rate control valve 30 has multiple switching patterns (switching positions) such as exemplified in FIG. 5, and switches between these switching patterns in accordance with the rotor angle changed by the electric actuator.

Specifically, flow rate control valve 30 closes all inlet ports 31 to 34 when the rotor angle is within a predetermined angle range from a reference angular position at which the rotor is regulated by a stopper. The position at which flow rate control valve 30 closes all inlet ports 31 to 34 will be referred to as a first pattern or a first position.

Note that the conditions in which all inlet ports 31 to 34 are closed include not only the condition in which the opening area of each of inlet ports 31 to 34 is zero. These conditions also include the conditions in which the opening area of each of inlet ports 31 to 34 is the minimum value greater than zero, in other words, the conditions in which the cooling water leaks from inlet ports 31 to 34.

When the rotor angle is increased to greater than the angle at which all inlet ports 31 to 34 are closed, third inlet port 33 connected to the outlet of the heater-core cooling liquid line opens to a predetermined extent. After that, flow rate control valve 30 maintains this predetermined flow rate while the rotor angle is increased.

The position at which third inlet port 33 opens will be referred to as a second pattern or a second position.

When the rotor angle is increased to greater than the angle at which third inlet port 33 is opened to the predetermined extent, first inlet port 31 connected to the outlet of the block cooling liquid line starts to open. The opening area of first inlet port 31 gradually increases as the rotor angle increases.

The position at which first inlet port 31 opens will be referred to as a third pattern or a third position.

When the rotor reaches the angular position at which the rotor angle is greater than when first inlet port 31 starts to open, second inlet port 32 connected to the outlet of the power-transmission-system cooling liquid line opens to a predetermined extent. After that, flow rate control valve 30 maintains this predetermined extent of opening of second inlet port 32 while the rotor angle is increased.

The position at which second inlet port 32 opens will be referred to as a fourth pattern or a fourth position.

When the rotor reaches the angular position at which the rotor angle is greater than when second inlet port 32 opens to the predetermined extent, fourth inlet port 34 connected to the outlet of the radiator cooling liquid line starts to open. The opening area of fourth inlet port 34 gradually increases as the rotor angle increases.

The position at which fourth inlet port 34 opens will be referred to as a fifth pattern or a fifth position.

The cooling device includes a first temperature sensor 81 and a second temperature sensor 82. First temperature sensor 81 measures the temperature of the cooling water in first cooling water pipe 71 near cooling water outlet 14, that is, the cooling water temperature near the outlet of cylinder head 11. Second temperature sensor 82 measures the temperature of the cooling water in second cooling water pipe 72 near cooling water outlet 15, that is, the cooling water temperature near the outlet of cylinder block 12.

First temperature sensor 81 and second temperature sensor 82 respectively output a water temperature measurement signal TW1 and a water temperature measurement signal TW2, which are inputted to an electronic control device (controller or control unit) 100 including a microcomputer. In response, electronic control device 100 outputs operation signals to water pump 40 and flow rate control valve 30 so as to control the discharge rate of water pump 40 and the position (switching pattern) of flow rate control valve 30.

Also, electronic control device 100 has a function of controlling a fuel injection device 17 and an ignition device 18 for internal combustion engine 10, and a function (idle reduction function) of temporarily stopping internal combustion engine 10 while, for example, the vehicle waits for a traffic light.

An electronic control device having the functions of controlling internal combustion engine 10 may be provided separately from electronic control device 100. In this case, the electronic control device for controlling internal combustion engine 10 and electronic control device 100 for controlling the cooling system including water pump 40 and flow rate control valve 30 communicate with each other.

Next, description will be given of the control that electronic control device 100 performs on water pump 40 and flow rate control valve 30.

As will be described in detail later, electronic control device 100 has the functions of sequentially switching the rotor angle (switching pattern) of flow rate control valve 30 while changing the discharge rate of water pump 40, along with the progression of the warm-up of internal combustion engine 10. In addition, electronic control device 100 has the functions of controlling the temperatures of cylinder head 11 and cylinder block 12 close to their target values.

Figure 2:
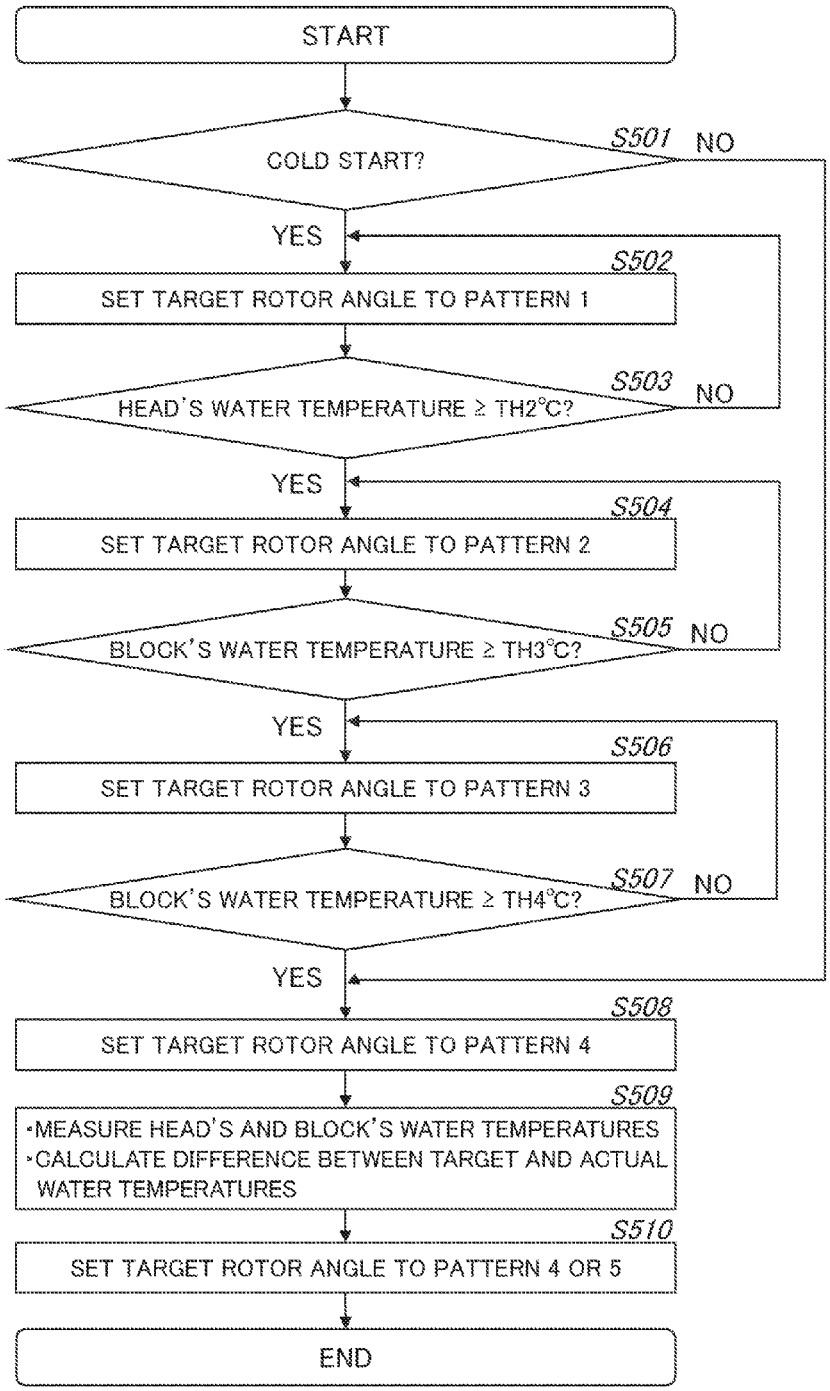
FIG. 2 is a flowchart representing control of a flow rate control valve according to the embodiment of the present invention.

The flowchart of FIG. 2 represents an example of the control that electronic control device 100 performs on water pump 40 and flow rate control valve 30. Electronic control device 100 conducts the routine represented in the flowchart of FIG. 2 as interrupt processing with predetermined time intervals.

First, in step S501, by comparing a first threshold TH1 with the water temperature TW1 measured by first temperature sensor 81, that is, the water temperature TW1 at the outlet of cylinder head 11, electronic control device 100 determines whether internal combustion engine 10 is started up from cold start or restarted just after being stopped operating, that is, started at a high temperature.

When electronic control device 100 determines that internal combustion engine 10 is started up from cold start where the water temperature TW1 is below the first threshold TH1, the operation proceeds to step S502.

On the other hand, when electronic control device 100 determines that internal combustion engine 10 is started from the warmed-up condition in which the water temperature TW1 is above the first threshold TH1, the operation skips steps S502 to S507 and proceeds to step S508.

When determining that internal combustion engine 10 is at cold start, electronic control device 100 sets a target rotor angle for flow rate control valve 30 according to the first pattern in the next step S502.

In other words, in step S502, electronic control device 100 sets the target rotor angle for flow rate control valve 30 to a value corresponding to the angular position at which all first to fourth inlet ports 31 to 34 are closed.

Figure 3:
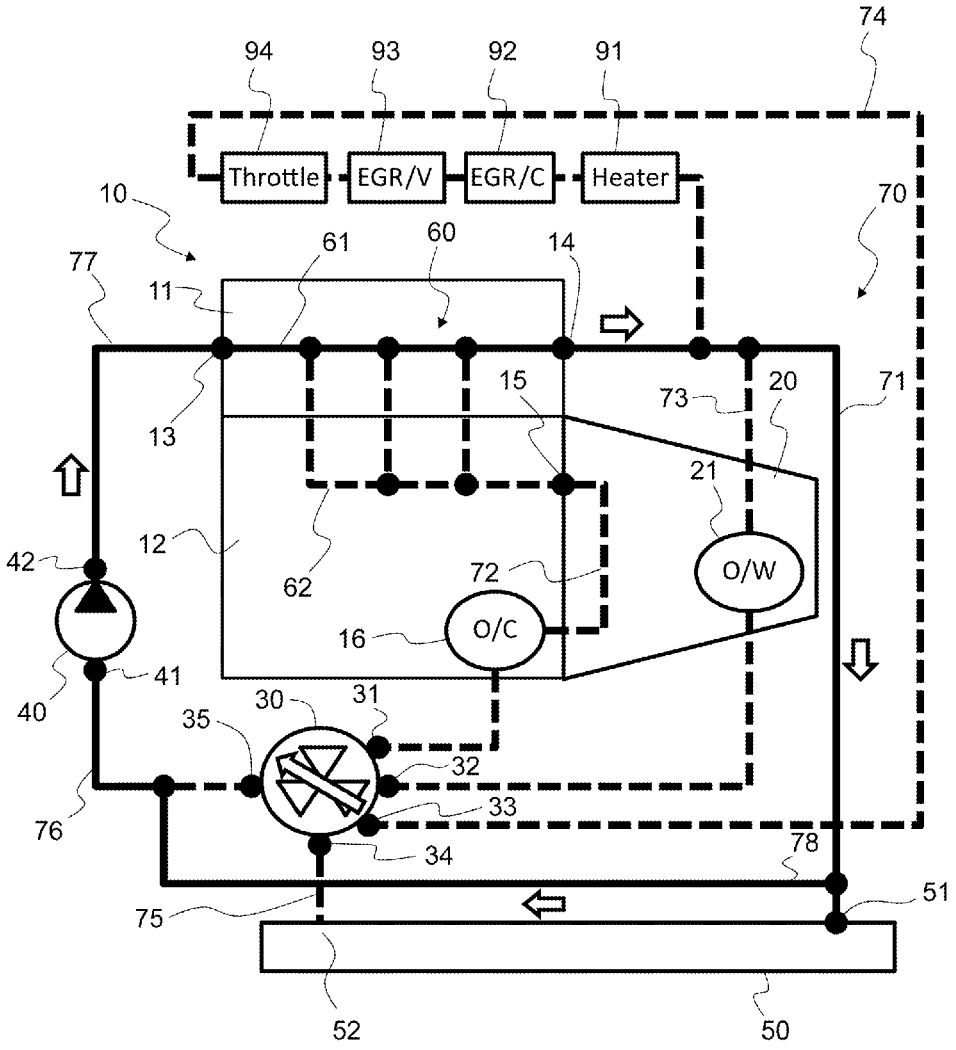
FIG. 3 is a state diagram illustrating a first pattern of a cooling water circulation route according to the embodiment of the present invention.

As illustrated in FIG. 3, this target angle setting stops the cooling water circulation by way of first to fourth inlet ports 31 to 34. In this case, the cooling water discharged from water pump 40 circulates through the route by which the cooling water flows through seventh cooling water pipe 77, cooling water passage 61, first cooling water pipe 71 and eighth cooling water pipe 78, and returns to be drawn into water pump 40.

In other words, in the first pattern, the cooling water is supplied only to the bypass line while the cooling water supply to the first to fourth cooling liquid lines is stopped.

This allows for the circulation in which the cooling water having passed through cylinder head 11 returns to cylinder head 11 while bypassing radiator 50, and prevents the cooling water from circulating by way any of cylinder block 12, oil cooler 16, oil warmer 21, heater core 91, EGR cooler 92, exhaust gas recirculation control valve 93 and throttle valve 94.

In the first pattern, electronic control device 100 sets the target discharge flow rate of water pump 40 to a value for increasing the temperature of cylinder head 11 from cold start. This target value for increasing the temperature of cylinder head 11 is set to a flow rate as low as possible within a range that allows first temperature sensor 81 to detect temperature change in cylinder head 11 and that can prevent temperature variation of the cooling water in cylinder head 11. For example, this target value is set to approximately three to ten liters per second.

In other words, at cold start, electronic control device 100 chooses the first pattern while lowering the discharge flow rate of water pump 40. Thereby, electronic control device 100 accelerates the temperature rise in cylinder head 11 and achieves quicker improvement of the combustibility of internal combustion engine 10 so as to improve the fuel economy thereof.

Stopping the cooling water supply to cooling water passage 61 will lower the performance to cool cylinder head 11, and thus can accelerate the temperature rise in cylinder head 11. However, this causes the cooling water to be retained in cooling water passage 61, and thus reduces the accuracy of first temperature sensor 81 in measuring the temperature of cylinder head 11, or causes temperature variation of the cooling water in cylinder head 11, which may leads to the thermal distortion thereof. To address this, the cooling water is circulated at a flow rate as low as possible within a range that allows first temperature sensor 81 to detect temperature changes in cylinder head 11 and that can prevent the thermal distortion of cylinder head 11.

In addition, it is considered that temperature rise in cylinder head 11 can further be accelerated, if heat release from the cooling water circulating through cooling water passage 61 in cylinder head 11 is reduced.

To achieve this, in the first pattern, the cooling water circulates through cooling water passage 61 by the route including no device that absorbs heat from the cooling water. Specifically, electronic control device 100 blocks the third cooling liquid line, which is routed by way of heater core 91, the second cooling liquid line, which is routed by way of oil cooler 16, the first cooling liquid line, which is routed by way of radiator 50, and the fourth cooling liquid line, which is routed by way of oil warmer 21.

This allows the cooling water to circulate through the route by which the cooling water discharged from cooling water passage 61 in cylinder head 11 returns to water pump 40 and cooling water passage 61 while bypassing heat-absorbing devices such as radiator 50 and heater core 91.

As described above, electronic control device 100 accelerates the temperature rise in cylinder head 11 by detecting the temperature change in cylinder head 11 using first temperature sensor 81 and by circulating the cooling water through cooling water passage 61 while bypassing the heat-absorbing devices such as radiator 50 and heater core 91 at a flow rate as low as possible within a range that can prevent the thermal distortion of cylinder head 11.

Figure 4:
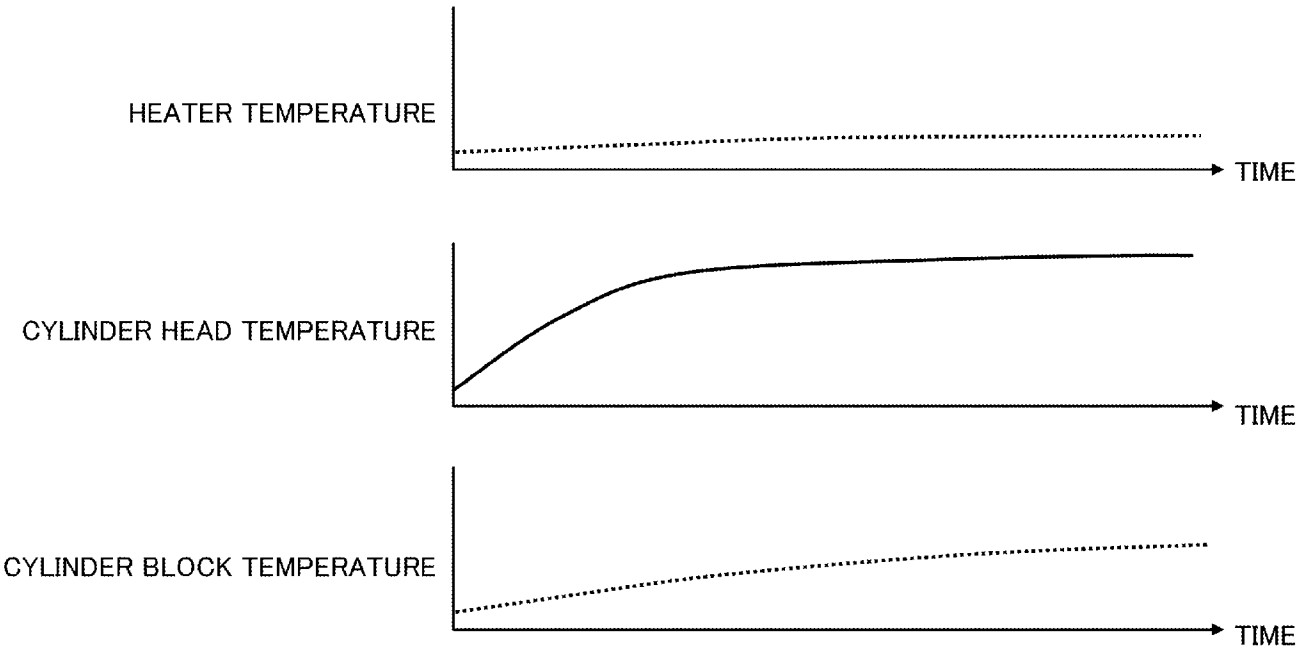
FIG. 4 is a time chart exemplifying temperature changes in the first pattern of the circulation route according to the embodiment of the present invention.

FIG. 4 displays changes in the cooling water temperatures in heater core 91, in cylinder head 11 and in cylinder block 12 while electronic control device 100 controls flow rate control valve 30 in the first pattern.

In the first pattern, the cooling water is circulated through cylinder head 11 while bypassing the heat-absorbing devices such as radiator 50 and heater core 91. Thus, the first pattern makes it possible to increase the temperature of cylinder head 11 as quickly as possible while preventing the thermal distortion thereof.

Note that, in the first pattern, the cooling water temperature in cylinder block 12 also gradually increases by convection from cylinder head 11, frictional heat generation in cylinder block 12 and the like.

FIG. 5 exemplifies switching control of flow rate control valve 30 at cold start. At cold start, flow rate control valve 30 is maintained in the first pattern while the discharge rate of water pump 40 is reduced as possible within a range that can prevent the thermal distortion of cylinder head 11. These conditions are maintained until the temperature of cylinder head 11 is sufficiently increased.

Under the condition in which electronic control device 100 controls flow rate control valve 30 according to the first pattern, the operation proceeds to step S503, in which electronic control device 100 compares a second threshold TH2 with the water temperature TW1 at the outlet of cylinder head 11.

Here, the second threshold TH2 is set to a temperature higher than the first threshold TH1. Specifically, the second threshold TH2 is set to an appropriate value ensuring that the temperature of cylinder head 11 increases enough to allow internal combustion engine 10 to provide sufficient combustibility, in other words, ensuring that the warm-up of cylinder head 11 is completed. For example, the second threshold TH2 is set to a temperature within the range of from 80° C. to 100° C.

When electronic control device 100 determines that the water temperature TW1 does not reach the second threshold TH2, the operation returns to step S502, in which electronic control device 100 continues to control flow rate control valve 30 according to the first pattern.

In other words, when TW1<TH2 is true, the temperature of cylinder head 11 is not increased enough to allow internal combustion engine 10 to provide sufficient combustibility. Thus, electronic control device 100 continues the control according to the first pattern so as to accelerate the temperature rise in cylinder head 11.

When the water temperature TW1 reaches the second threshold TH2, the operation of electronic control device 100 proceeds to step S504.

In step S504, electronic control device 100 sets the target rotor angle for flow rate control valve 30 according to the second pattern.

In other words, in step S504, electronic control device 100 sets the target rotor angle to a value corresponding to the angular position at which third inlet port 33 opens while first, second and fourth inlet ports 31, 32 and 34 are maintained to be closed.

Flow rate control valve 30 closes all first to fourth inlet ports 31 to 34 when the rotor is at one of the limit angular positions within the variable range of the rotor angle. In addition, flow rate control valve 30 gradually increases the opening area of third inlet port 33 while maintaining first, second and fourth inlet ports 31, 32 and 34 to be closed, by changing the rotor angle from this limit angular position.

Thus, when electronic control device 100 changes the rotor angle of flow rate control valve 30, the control is directly switched from the first pattern to the second pattern.

Figure 6:
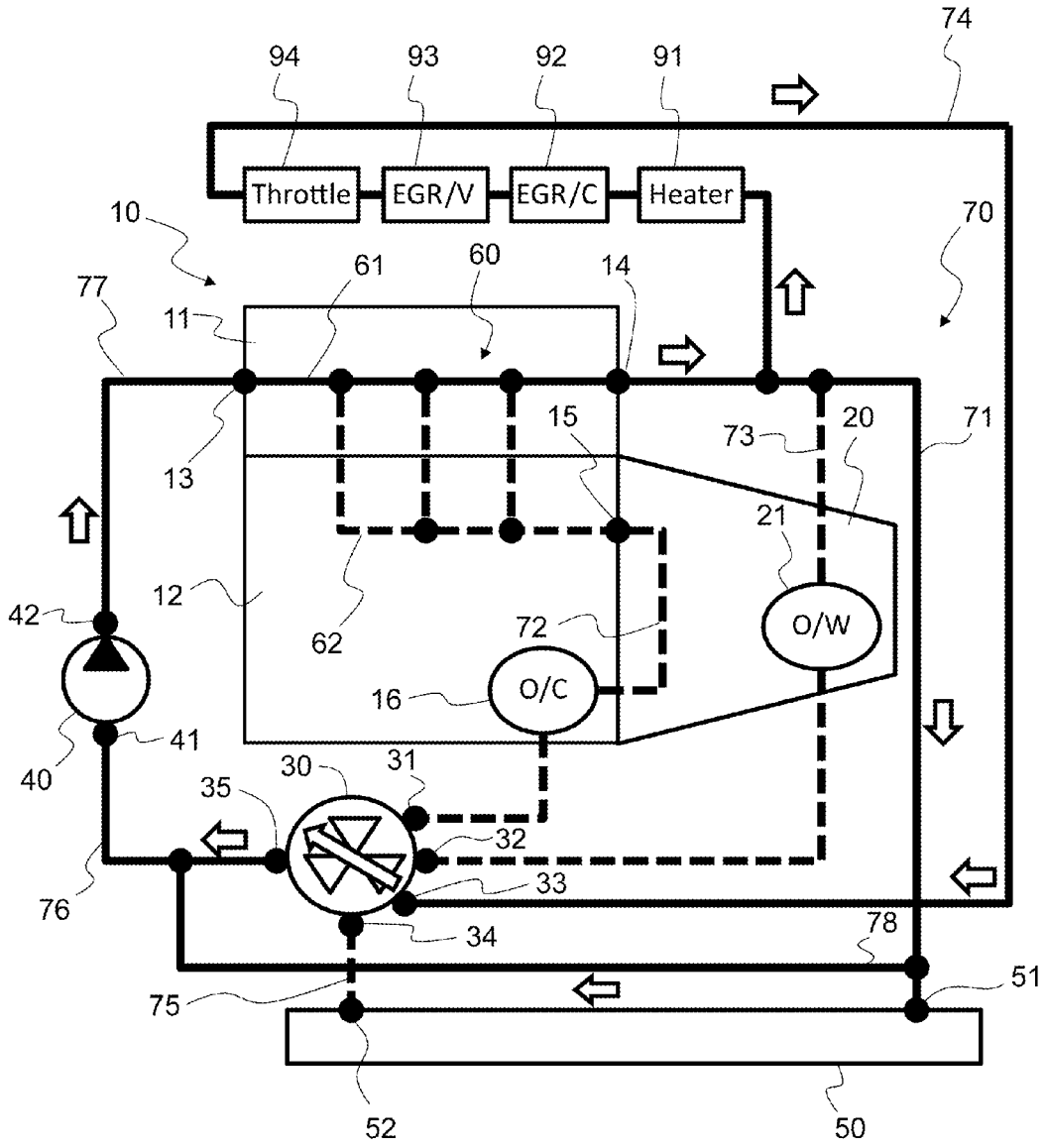
FIG. 6 is a state diagram illustrating a second pattern of cooling water circulation routes according to the embodiment of the present invention.

As illustrated in FIG. 6, the target angle setting according to the second pattern makes the cooling water circulation by way of third inlet port 33 started while continuing to stop the cooling water circulation by way of first, second and fourth inlet ports 31, 32 and 34.

Thereby, some of the cooling water discharged from water pump 40 starts to circulate through the route by which the cooling water flows through seventh cooling water pipe 77, cooling water passage 61, fourth cooling water pipe 74, flow rate control valve 30 and sixth cooling water pipe 76, and returns to be drawn into water pump 40. Meanwhile, some of the cooling water discharged from cooling water passage 61 circulates through first cooling water pipe 71 and eighth cooling water pipe 78.

In other words, in the second pattern, the cooling water is supplied to the third cooling liquid line and the bypass line while the cooling water supply to the first, second and fourth cooling liquid lines is maintained to be stopped.

In the second pattern, the cooling water having passed through cylinder head 11 is partially diverted to fourth cooling water pipe 74. This allows the diverted cooling water to exchange heat with heater core 91, EGR cooler 92, exhaust gas recirculation control valve 93 and throttle valve 94 disposed on fourth cooling water pipe 74.

In addition, in the second pattern, the cooling water circulates through the routes each of which bypasses radiator 50 without flowing through second cooling water pipe 72 into cylinder block 12 that has not sufficiently warmed up and without flowing through oil warmer 21 disposed on third cooling water pipe 73. Thus, the cooling water can be maintained at a high temperature.

This allows the cooling water at a sufficiently high temperature to be supplied to fourth cooling water pipe 74 on which the heater devices such as heater core 91 are disposed, thus allowing for the quicker response of the air heating that uses heat exchange in heater core 91.

In the second pattern setting, along with the progression of the warm-up of internal combustion engine 10, electronic control device 100 incrementally increases the target rotor angle for flow rate control valve 30 to increase the opening area of third inlet port 33 while gradually increase the discharge flow rate of water pump 40 from that in the first pattern. Thereby, electronic control device 100 maintains the water temperature TW1 at the outlet of cylinder head 11 at approximately the second threshold TH2.

For example, in the second pattern, electronic control device 100 increases the discharge flow rate of water pump 40 to approximately ten to sixty liters per second from approximately three to ten liters per second in the first pattern.

In addition, in the second pattern, electronic control device 100 increases the opening area of third inlet port 33 by increasing the rotor angle of flow rate control valve 30 just before the rotor reaches the angular position of switching to the third pattern, that is, just before first inlet port 31 starts to open.

Figure 7:
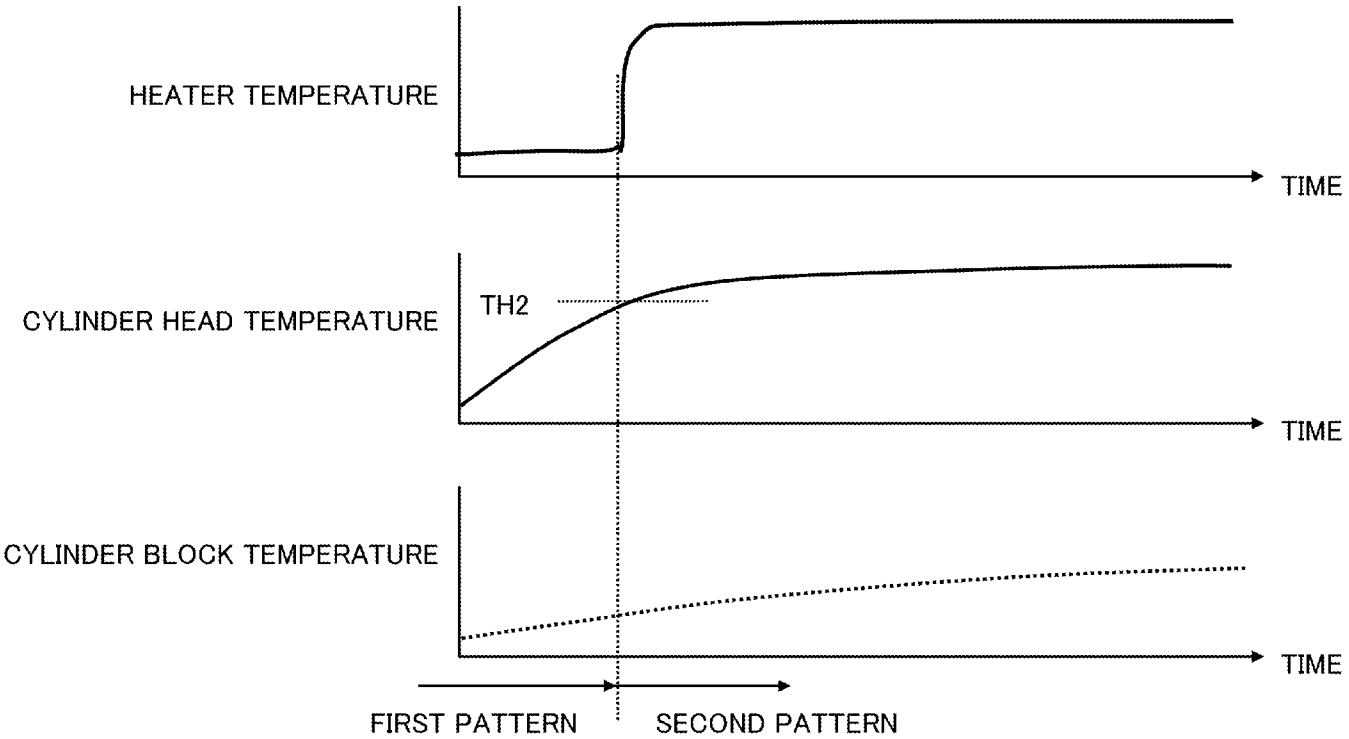
FIG. 7 is a time chart exemplifying temperature changes in the second pattern of the circulation routes according to the embodiment of the present invention.

FIG. 7 displays changes in the cooling water temperatures in heater core 91, in cylinder head 11 and in cylinder block 12 while electronic control device 100 controls flow rate control valve 30 in the second pattern.

As displayed in FIG. 7, when the cooling water temperature in cylinder head 11 reaches approximately the second threshold TH2, the control is switched from the first pattern to the second pattern. In the second pattern, some of the cooling water having passed through cylinder head 11 is supplied to fourth cooling water pipe 74. This increases the cooling water temperature in heater core 91 and allows heater core 91 to heat air for air conditioning to a high temperature through heat exchange.

Note that, while flow rate control valve 30 is controlled in the second pattern, the cooling water temperature in cylinder block 12 also continues to gradually increase by convection from cylinder head 11, frictional heat generation in cylinder block 12 and the like.

FIG. 5 displays the switching timing from the first pattern to the second pattern, and changes in the flow rate of the cooling water in the second pattern.

In the period from time point t0, when internal combustion engine 10 is started up to time point t1 when the temperature of cylinder head 11 reaches approximately the second threshold TH2, the control is maintained in the first pattern. At time point t1, the control is switched from the first pattern to the second pattern.

While controlling flow rate control valve 30 in the second pattern, electronic control device 100 performs processing for increasing the opening area of third inlet port 33 and the discharge rate of water pump 40 to prevent the temperature of cylinder head 11 from going beyond the second threshold TH2.

Under the conditions in which electronic control device 100 circulates the cooling water by way of heater core 91, the operation proceeds to step S505. In step S505, electronic control device 100 compares the third threshold TH3 with the water temperature measurement signal TW2 outputted by second temperature sensor 82, that is, the water temperature TW2 at the outlet of cylinder block 12.

The third threshold TH3 is set to a temperature equal to the second threshold TH2, or a temperature higher or lower than the second threshold TH2 by a predetermined temperature difference.

By comparing the third threshold TH3 with the water temperature TW2 at the outlet of cylinder block 12, electronic control device 100 detects whether the temperature of cylinder block 12 reaches the temperature for starting the cooling water supply to cylinder block 12, in other words, whether the warm-up of cylinder block 12 is completed.

While the water temperature TW2 at the outlet of cylinder block 12 is below the third threshold TH3, that is, during the warm-up of cylinder block 12, the operation returns to step S504, in which electronic control device 100 continues to control flow rate control valve 30 and water pump 40 according to the second pattern.

On the other hand, when the water temperature TW2 at the outlet of cylinder block 12 becomes not less than the third threshold TH3, the operation of electronic control device 100 proceeds to step S506.

In step S506, electronic control device 100 sets the target rotor angle for flow rate control valve 30 according to the third pattern.

In other words, in step S506, electronic control device 100 sets the target rotor angle to a value corresponding to the angular position at which first inlet port 31 of flow rate control valve 30 opens while second and fourth inlet ports 32 and 34 are maintained to be closed and the opening area of third inlet port 33 of flow rate control valve 30 is maintained at the upper limit.

When the rotor angle of flow rate control valve 30 goes beyond the upper limit for the second pattern, the opening area of first inlet port 31 gradually increases while second and fourth inlet ports 32 and 34 are maintained to be closed and the opening area of third inlet port 33 is maintained at the upper limit. Thus, when electronic control device 100 changes the rotor angle of flow rate control valve 30, the control is directly switched from the second pattern to the third pattern.

Figure 8:
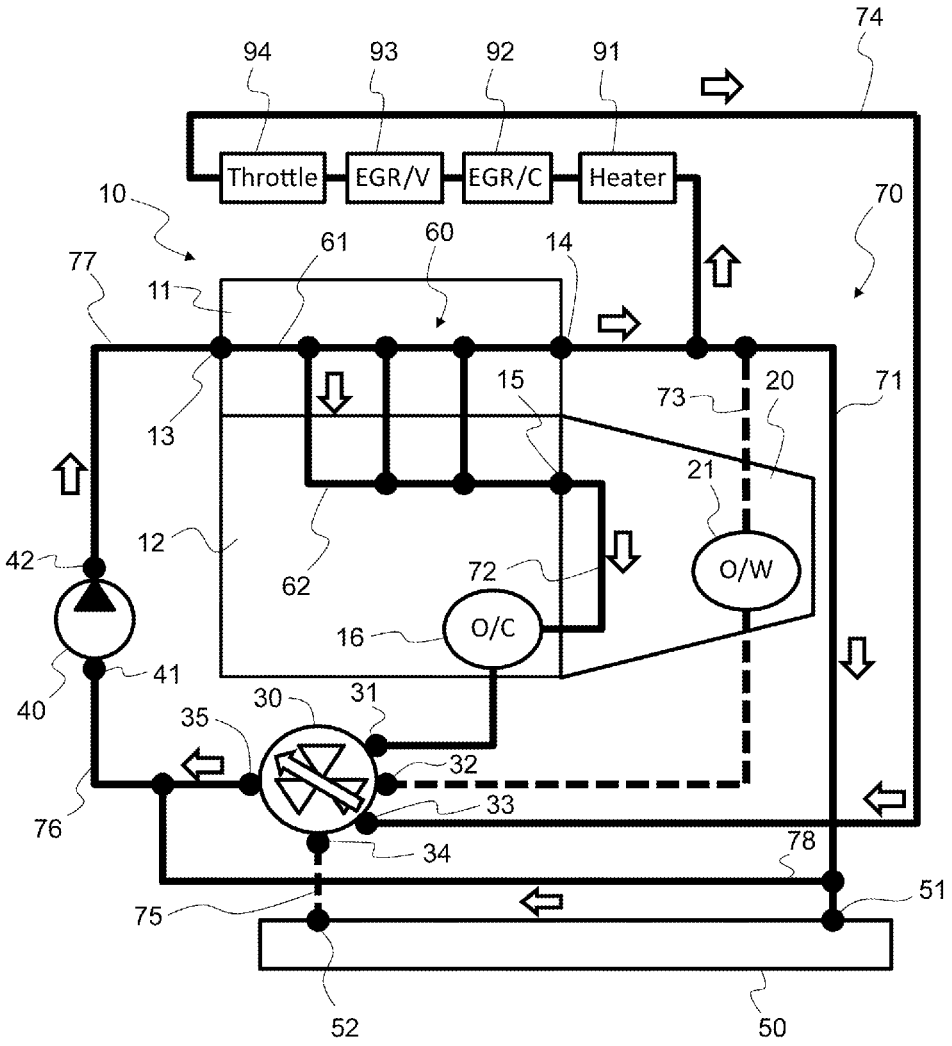
FIG. 8 is a state diagram illustrating a third pattern of cooling water circulation routes according to the embodiment of the present invention.

As illustrated in FIG. 8, the target angle setting according to the third pattern makes the cooling water circulation by way of first inlet port 31 started while continuing to stop the cooling water circulation by way of second and fourth inlet ports 32 and 34 and while maintaining the cooling water circulation by way of third inlet port 33.

Thereby, some of the cooling water discharged from water pump 40 starts to circulate through the route by which the cooling water flows through cooling water passage 62, second cooling water pipe 72, flow rate control valve 30 and sixth cooling water pipe 76, and returns to be drawn into water pump 40.

In other words, in the third pattern, the cooling water is supplied to the second and third cooling liquid lines and the bypass line while the cooling water supply to the first and fourth cooling liquid lines maintained to be stopped.

Thereby, in the third pattern, some of the cooling water discharged from water pump 40 is supplied to cylinder block 12 so as to control the temperature of cylinder block 12.

In the third pattern setting, along with an increase in the water temperature TW2 at the outlet of cylinder block 12, electronic control device 100 incrementally increases the target rotor angle for flow rate control valve 30 to increase the opening area of first inlet port 31 while gradually increase the discharge flow rate of water pump 40 from that in the second pattern.

Note that, in the third pattern, electronic control device 100 increases the opening area of first inlet port 31 till the rotor angle of flow rate control valve 30 reaches the upper limit for the third pattern by increasing the rotor angle just before the rotor reaches the angular position of switching to the fourth pattern, in other words, just before second inlet port 32 starts to open.

By controlling the cooling water supply to cylinder block 12 through the control on flow rate control valve 30 and water pump 40 according to the third pattern, electronic control device 100 gradually increases the temperature of cylinder block 12 to the target value while preventing the temperature of cylinder block 12 from overshooting beyond the target value.

Figure 9:
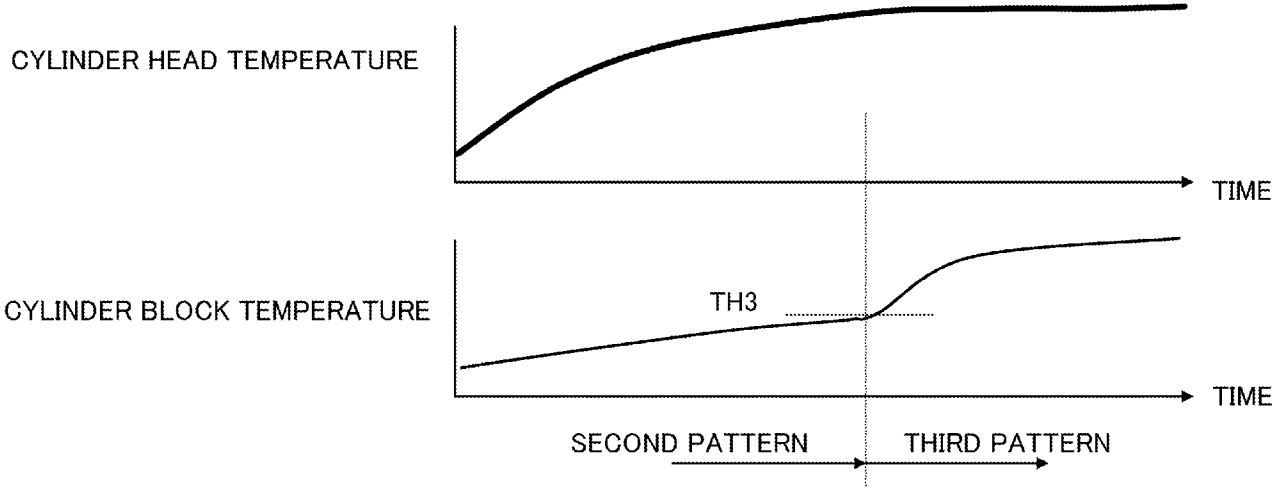
FIG. 9 is a time chart exemplifying temperature changes in the third pattern of the circulation routes according to the embodiment of the present invention.

FIG. 9 displays changes in the cooling water temperatures in cylinder head 11 and in cylinder block 12 while electronic control device 100 controls flow rate control valve 30 in the third pattern.

As displayed in FIG. 9, when the cooling water temperature in cylinder block 12 reaches approximately the third threshold TH3, the control is switched from the second pattern to the third pattern. In the third pattern, the cooling water supplied to cooling water passage 61 is partially diverted to cooling water passage 62, and circulates through cooling water passage 62, oil cooler 16 and flow rate control valve 30. This increases the cooling water temperature in cylinder block 12.

FIG. 5 displays the switching timing from the second pattern to the third pattern, and changes in the flow rate of the cooling water in the third pattern.

At time point t2 when the temperature of cylinder block 12 reaches approximately the third threshold TH3, the control is switched from the second pattern to the third pattern.

In the third pattern, to prevent the temperature of cylinder head 11 from going beyond the second threshold TH2, electronic control device 100 performs processing for increasing the opening area of first inlet port 31 and the discharge rate of water pump 40 so as to gradually increase the temperature of cylinder block 12.

Under the conditions in which electronic control device 100 controls flow rate control valve 30 according to the third pattern so as to circulate the cooling water by way of cylinder block 12, the operation proceeds to step S507. In step S507, electronic control device 100 compares the fourth threshold TH4 with the water temperature TW2 at the outlet of cylinder block 12.

The fourth threshold TH4 is the target temperature value for cylinder block 12, and set to a value that is higher than the second threshold TH2, which is the target temperature for cylinder head 11, and that is higher than the third threshold TH3 for starting the cooling water supply to cylinder block 12. For example, the fourth threshold TH4 is set to a value approximately between 100° C. and 110° C.

In other words, the target temperature for cylinder block 12 is set with the aim of reducing friction therein, while the target temperature for cylinder head 11 is set with the aim of reducing pre-ignition and knocking. Thus, the target temperature for cylinder block 12 is set higher than the target temperature for cylinder head 11 so as to more effectively reduce friction in cylinder block 12.

When the water temperature TW2 at the outlet of cylinder block 12 is below the fourth threshold TH4, the operation returns to step S506, in which electronic control device 100 continues to control flow rate control valve 30 and water pump 40 according to the third pattern.

On the other hand, when the water temperature TW2 at the outlet of cylinder block 12 reaches the fourth threshold TH4, which is the target temperature for cylinder block 12, the operation of electronic control device 100 proceeds to step S508.

In step S508, electronic control device 100 sets the target rotor angle for flow rate control valve 30 according to the fourth pattern.

In other words, in step S508, electronic control device 100 sets the target rotor angle to a value corresponding to the angular position at which the opening area of second inlet port 32 reaches the upper limit, while fourth inlet port 34 is maintained to be closed, the opening area of third inlet port 33 is maintained at the upper limit, and the opening area of first inlet port 31 continues to increase as in the previous third pattern.

When the rotor angle of flow rate control valve 30 goes beyond the upper limit for the third pattern, second inlet port 32 opens till its opening area reaches the upper limit and the opening area of first inlet port 31 continues to increase as in the previous third pattern while fourth inlet port 34 is maintained to be closed and the opening area of third inlet port 33 is maintained at the upper limit. Thus, when electronic control device 100 changes the rotor angle of flow rate control valve 30, the control is directly switched from the third pattern to the fourth pattern.

Figure 10:
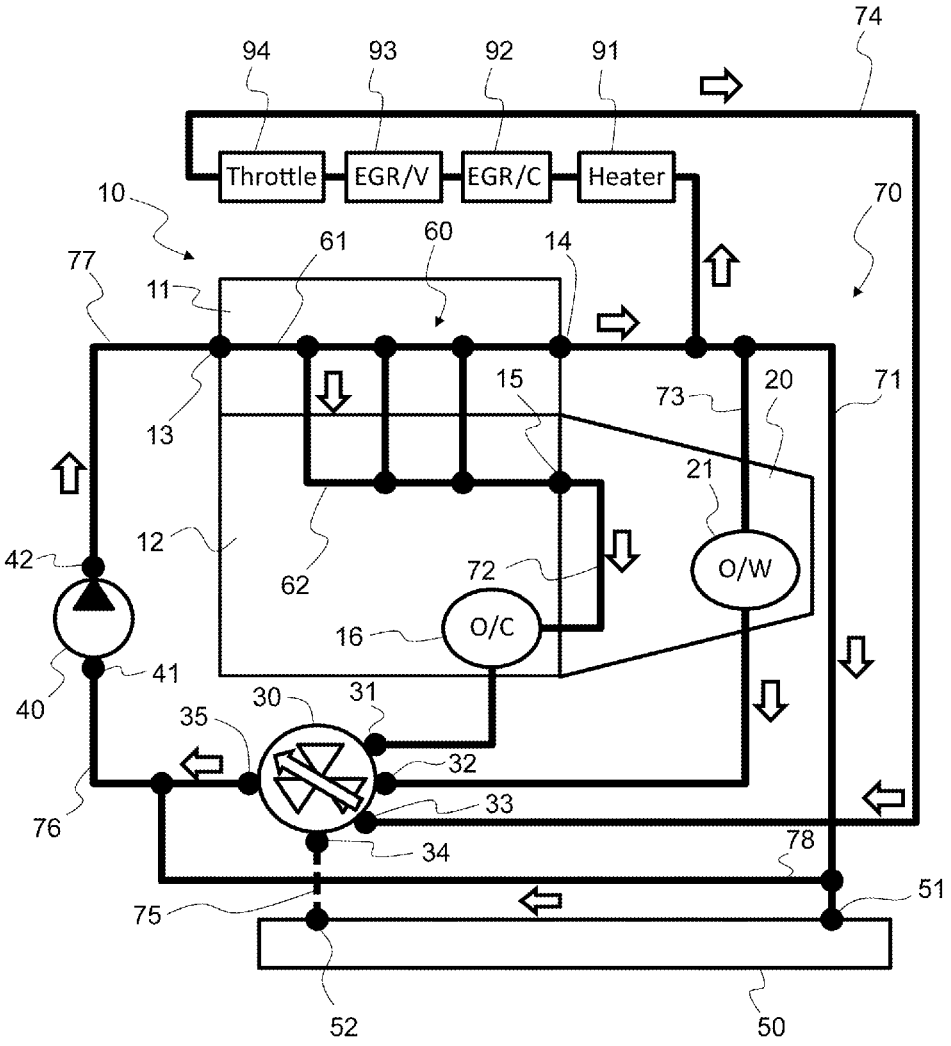
FIG. 10 is a state diagram illustrating a fourth pattern of cooling water circulation routes according to the embodiment of the present invention.

As illustrated in FIG. 10, in the fourth pattern, the cooling water supply to transmission 20 and oil warmer 21 is started, while the cooling water circulation by way of radiator 50 still continues to be stopped as in the preceding first to third patterns. As a result, the cooling water is supplied to cylinder block 12, heater core 91, oil warmer 21 and the bypass line.

In addition, by opening second inlet port 32, the cooling water having passed through cylinder head 11 is partially diverted to fourth cooling water pipe 74, so that the diverted cooling water circulates through the route by which the cooling water flows through fourth cooling water pipe 74 to flow rate control valve 30 by way of oil warmer 21, and returns to be drawn into water pump 40. Thereby, oil warmer 21 exchanges heat between the hydraulic oil of transmission 20 and the cooling water, thereby accelerating the warm up of transmission 20.

In addition, at the same time of performing the processing for opening second inlet port 32, electronic control device 100 performs processing for increasing the discharge rate of water pump 40 as compared to that in the third pattern so as to supply a sufficient amount of the cooling water into each of first to fourth cooling water pipes 71 to 74.

Figure 11:
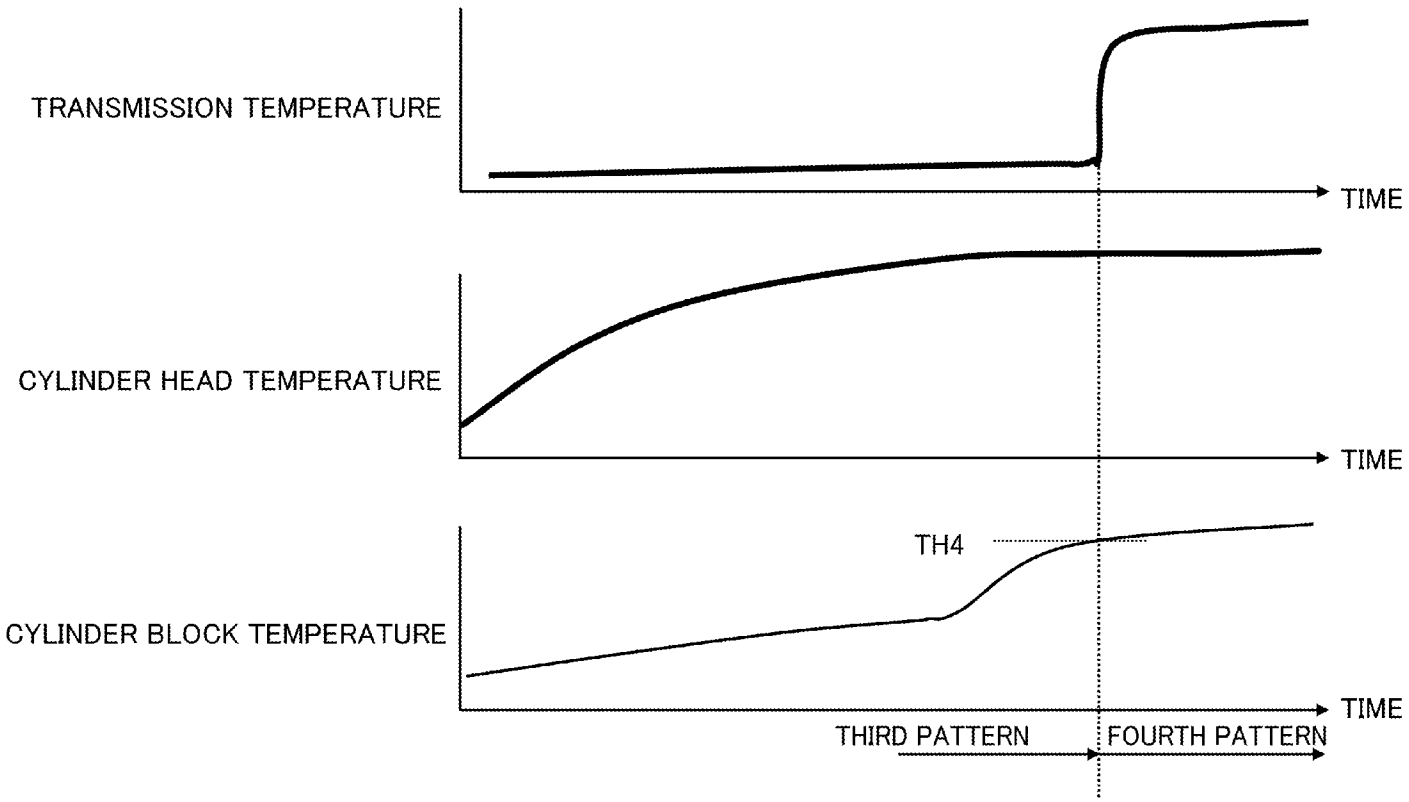
FIG. 11 is a time chart exemplifying temperature changes in the fourth pattern of the circulation routes according to the embodiment of the present invention.

FIG. 11 displays changes in the cooling water temperatures in oil warmer 21, in cylinder head 11 and in cylinder block 12 while electronic control device 100 controls flow rate control valve 30 in the fourth pattern.

As displayed in FIG. 11, when the cooling water temperature in cylinder block 12 reaches approximately the fourth threshold TH4, the control is switched from the third pattern to the fourth pattern. In the fourth pattern, the cooling water supplied to cooling water passage 61 is partially diverted to third cooling water pipe 73 so as to circulate by way of oil warmer 21. This increases the cooling water temperature in oil warmer 21.

FIG. 5 displays the switching timing from the third pattern to the fourth pattern, and changes in the flow rate of the cooling water in the fourth pattern.

At time point t3 when the temperature of cylinder block 12 reaches approximately the fourth threshold TH4, electronic control device 100 switches the control from the third pattern to the fourth pattern. Thereby, electronic control device 100 opens second inlet port 32 to the predetermined extent so as to start the cooling water circulation by way of oil warmer 21 and to maintain the temperature of cylinder head 11 at approximately the second threshold TH2. In addition, electronic control device 100 changes the opening area of first inlet port 31 and controls the discharge rate of water pump 40 so as to maintain the temperature of cylinder block 12 at approximately the fourth threshold TH4.

After electronic control device 100 starts to control flow rate control valve 30 according to the fourth pattern in step S508, the operation proceeds to step S509. In step S509, electronic control device 100 calculates a difference ΔTC between the fourth threshold TH4 and the water temperature TW2 at the outlet of cylinder block 12 as well as a difference ΔTB between the second threshold TH2 and the water temperature TW1 at the outlet of cylinder head 11.

Then, the operation proceeds to step S510, in which electronic control device 100 performs switching control between the control patterns for flow rate control valve 30 on the basis of the temperature differences ΔTC and ΔTB calculated in step S509.

Specifically, electronic control device 100 performs this switching control as follows. When the load on internal combustion engine 10 increases, and, consequently, the water temperature TW2 at the outlet of cylinder block 12 and/or the water temperature TW1 at the outlet of cylinder head 11 become higher than their target values by not less than predetermined values, electronic control device 100 sets the target rotor angle for flow rate control valve 30 according to the fifth pattern. When the load on internal combustion engine 10 decreases, electronic control device 100 switches the target rotor angle back according to the fourth pattern.

In the fifth pattern, electronic control device 100 sets the target rotor angle to a value corresponding to the angular position at which fourth inlet port 34 opens from the fully closed state while the opening area of each of second and third inlet ports 32 and 33 is maintained at the upper limit, and the opening area of first inlet port 31 continues to increase as in the previous fourth pattern.

In other words, when the rotor angle of flow rate control valve 30 goes beyond the upper limit for the fourth pattern, the opening area of first inlet port 31 continues to increase further from when the rotor angle reaches the upper limit for the fourth pattern, and fourth inlet port 34 opens so as to gradually increase its opening area, while the opening area of each of second and third inlet ports 32 and 33 is maintained at the upper limit. Thus, when electronic control device 100 changes the rotor angle of flow rate control valve 30, the control is directly switched from the fourth pattern to the fifth pattern.

Figure 12:
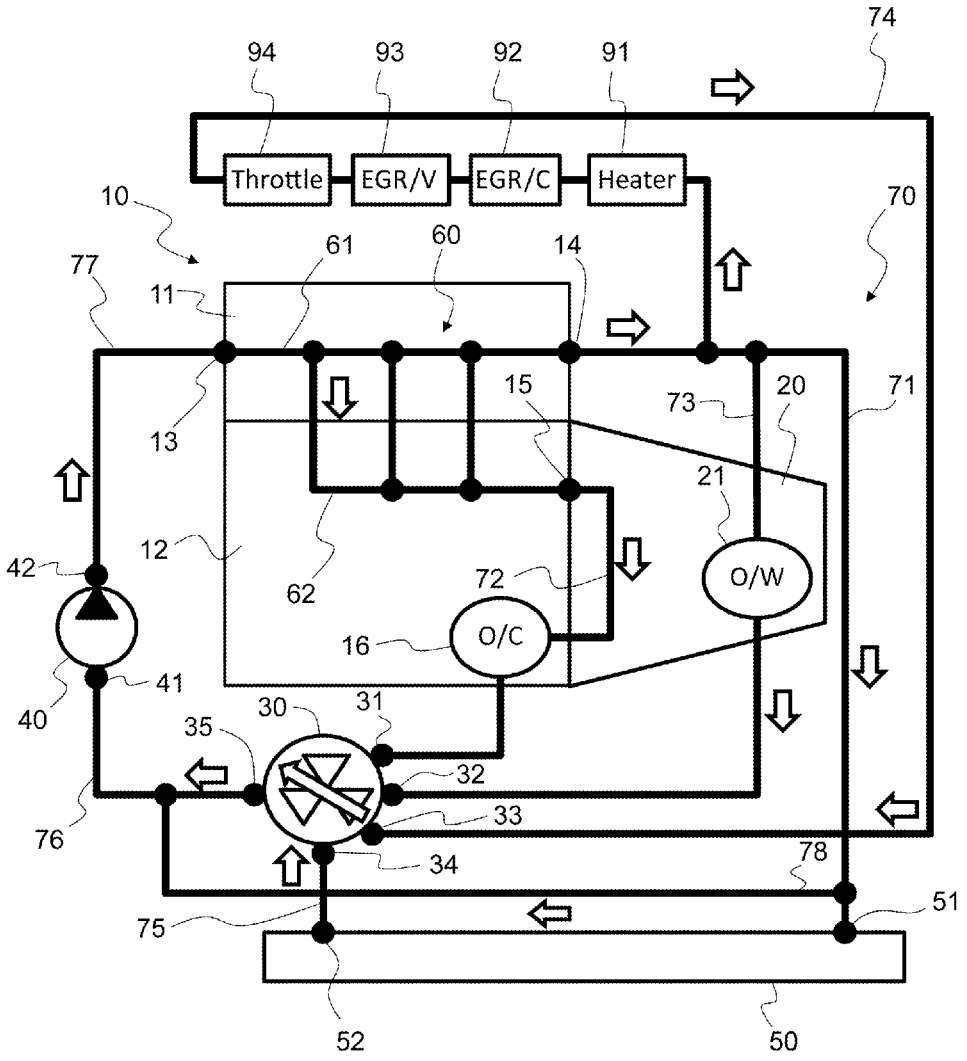
FIG. 12 is a state diagram illustrating a fifth pattern of cooling water circulation routes according to the embodiment of the present invention.

As illustrated in FIG. 12, the target angle setting according to the fifth pattern changes the cooling water circulation from that bypassing radiator 50 to that allowing some of the cooling water to circulate by way of radiator 50. Since the cooling water releases heat while flowing through radiator 50, the cooling water becomes more able to cool internal combustion engine 10, thus preventing the overheating of internal combustion engine 10.

In addition, electronic control device 100 increases the discharge rate of water pump 40 as the opening area of fourth inlet port 31 increases.

As described above, during the control according to the fifth pattern, electronic control device 10 maintains the water temperature TW2 at the outlet of cylinder block 12 at approximately its target temperature while maintaining the water temperature TW1 at the outlet of cylinder head 11 at approximately its target temperature. Note, however, that, under high load conditions, electronic control device 10 prioritizes the suppressing of the temperature rise in cylinder head 11. Specifically, electronic control device 10 increases the opening area of fourth inlet port 34 and the discharge rate of water pump 40 when the temperature of cylinder head 11 is higher than its target value by not less than the predetermined value, even though this control is expected to lower the temperature of cylinder block 12 below its target value.

Thereby, while internal combustion engine 10 operates in a high load range, the temperature rise in cylinder head 11 can be sufficiently suppressed so that pre-ignition and knocking can be reduced. This makes it possible to reduce an amount of correcting a retarded degree of ignition timing for reducing pre-ignition and knocking, thus reducing degradation in the output performance of internal combustion engine 10.

FIG. 5 displays the switching timing from the fourth pattern to the fifth pattern, and changes in the flow rate of the cooling water in the fifth pattern.

Assume here that the temperature differences ΔTC and ΔTB go beyond their predetermined values at, for example, time point t4. In other words, assume that, at time point t4, the cooling water circulation that bypasses radiator 50 becomes insufficient for suppressing the temperature rise in cylinder head 11 and in cylinder block 12. In this case, electronic control device 10 switches the control from the fourth pattern to the fifth pattern, thereby starting the cooling water circulation by way of radiator 50 and increasing the opening area of fourth inlet port 34 to a level capable of suppressing the temperature rises in cylinder head 11 and in cylinder block 12. At the same time, electronic control device 10 increases the discharge rate of water pump 40.

At time point t5, electronic control device 10 switches the control to the pattern for prioritizing the suppressing of the temperature rise in cylinder head 11 over the maintaining of the temperature of cylinder block 12. Specifically, when internal combustion engine 10 operates at a high load, electronic control device 10 further increases the opening area of fourth inlet port 34 nor the discharge rate of water pump 40, thereby suppressing the temperature rise in cylinder head 11.

This increases not only the cooling water flowing through cylinder head 11 but also the cooling water flowing through cylinder block 12, and might cause the temperature drop of cylinder block 12 below its target value. However, electronic control device 100 prioritizes the suppressing of the temperature rise in cylinder head 11, and thus does not perform processing of reducing the opening area of fourth inlet port 34 and the discharge rate of water pump 40 even though the temperature of cylinder block 12 go below the target value.

Figure 13:
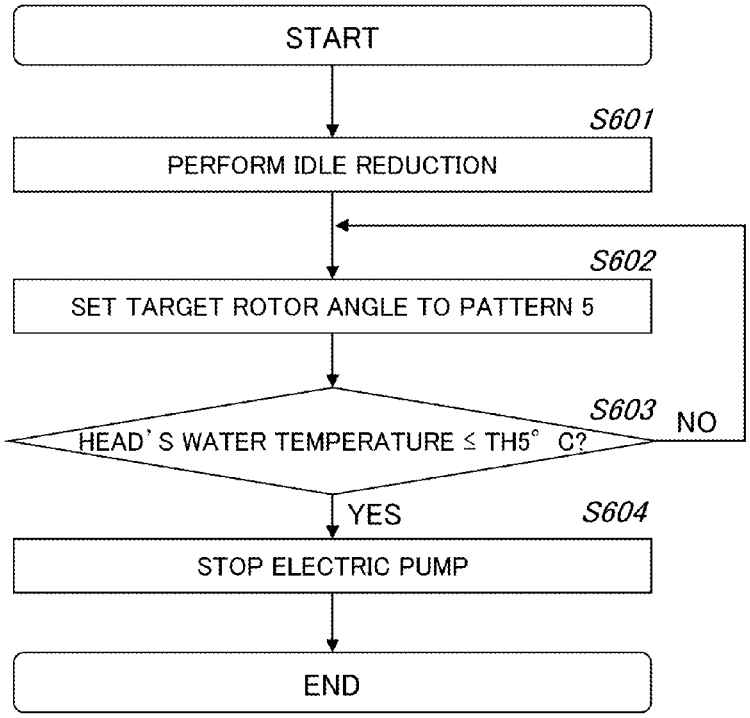
FIG. 13 is a flowchart representing control of the flow rate control valve under an idle reduction condition according to the embodiment of the present invention.

The routine exemplified in the flowchart of FIG. 13 is performed as the control in idle reduction, which is an example of the control that electronic control device 100 performs on flow rate control valve 30.

Electronic control device 100 conducts the routine represented in the flowchart of FIG. 13 as interrupt processing based on an idle reduction request signal.

First, in step S601, electronic control device 100 performs idle reduction control, specifically, control for stopping the fuel supply to internal combustion engine 10 and stopping ignition operation by an ignition plug.

Then, in step S602, electronic control device 100 controls the rotor angle of flow rate control valve 30 according to the fifth pattern so as to open inlet ports 31 to 34 of flow rate control valve 30 to circulate some of the cooling water by way of radiator 50. In addition, electronic control device 100 increases the discharge rate of water pump 40 to a target value for an idle reduction condition, which is higher than the discharge rate in the fifth pattern.

Then, the operation proceeds to step S603, in which electronic control device 100 detects whether the water temperature TW1 at the outlet of cylinder head 11 decreases to not more than a fifth threshold TH5.

Here, the fifth threshold TH5 may be set to a temperature equal to or lower than the second threshold TH2, for example.

When electronic control device 100 determines that the water temperature TW1 at the outlet of cylinder head 11 is above the fifth threshold TH5, the operation returns to step S602. In step S602, electronic control device 100 controls flow rate control valve 30 according to the fifth pattern so as to provide the cooling water circulation for reducing the temperature of cylinder head 11.

Then, when water temperature TW1 at the outlet of cylinder head 11 goes below the fifth threshold TH5, the operation proceeds from step S603 to step S604. In step S604, electronic control device 100 stops water pump 40 or reduces the discharge flow rate of water pump 40 to a value approximately equal to that in the first pattern.

Stopping the cooling water circulation for idle reduction will cause the temperature rise in cylinder head 11, and thus tend to cause pre-ignition and knocking at the restart of internal combustion engine 10.

In contrast, if, in a predetermined period immediately after internal combustion engine 10 stops for idle reduction, electronic control device 100 controls flow rate control valve 30 so as to circulate the cooling water by way of radiator 50 while driving water pump 40, the temperature rise in cylinder head 11 during idle reduction can be suppressed. Thus, the occurrence of pre-ignition and knocking is prevented or reduced to maintain a favorable startup performance at the restart of internal combustion engine 10 from the idle reduction condition.

Figure 14:
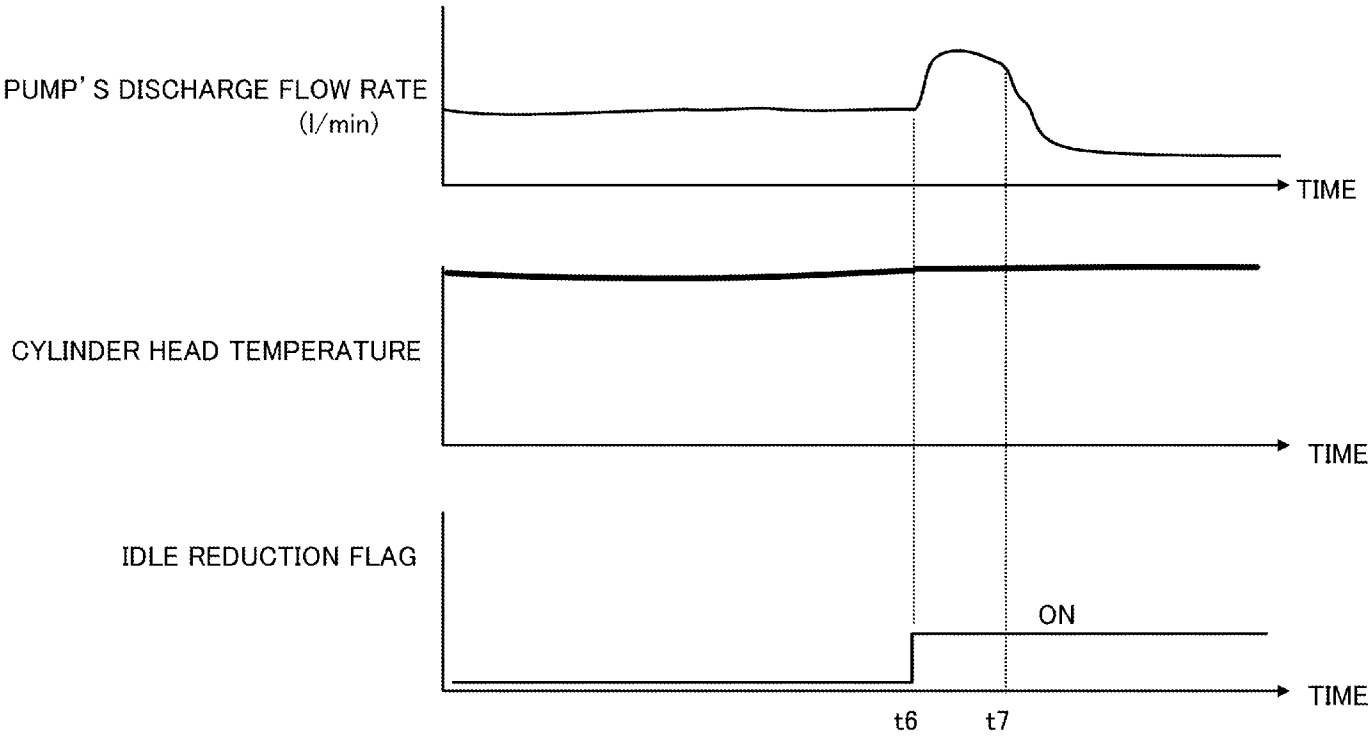
FIG. 14 is a time chart displaying changes in the cooling water temperature and in the discharge flow rate of a pump under the idle reduction condition according to the embodiment of the present invention.

FIG. 14 displays changes in the discharge rate of water pump 40 and in the temperature of cylinder head 11 during idle reduction.

As displayed in FIG. 14, at time point t6, idle reduction is started, and thus the operation of internal combustion engine 10 is stopped. In response, electronic control device 100 controls flow rate control valve 30 according to the fifth pattern so as to circulate the cooling water by way of radiator 50, and increases the discharge rate of water pump 40.

Then, when the water temperature TW1 at the outlet of cylinder head 11 goes below the fifth threshold TH5 at time point t7, and no temperature rise in cylinder head 11 is expected after time point t7, electronic control device 100 reduces the discharge rate of water pump 40.

As described above, the cooling device according to the present invention is capable of circulating the cooling water by way of cylinder head 11 while bypassing cylinder block 12 through the control on flow rate control valve 30. In addition, the cooling device is also capable of controlling the supply flow rate of the cooling water to cylinder head 11 at any flow rate through the control on electric water pump 40. Therefore, the cooling device allows the quicker warm-up of cylinder head 11, and thus provides the effect of improving the fuel economy of internal combustion engine 10.

Moreover, by controlling flow rate control valve 30, the cooling device can control the supply flow rate ratio of the cooling water between cylinder head 11 and cylinder block 12. In addition, electric water pump 40 is capable of circulating the cooling water at a high flow rate even while internal combustion engine 10 rotates at a low speed.

Thus, the cooling device can control cylinder head 11 and cylinder block 12 at mutually different target temperatures. This makes it possible to aggressively increase the temperature of cylinder block 12 enough to reduce friction therein while lowering the temperature of cylinder head 11 enough to reduce pre-ignition and knocking.

In addition, electric water pump 40 allows the cooling water to circulate by way of cylinder head 11 even while internal combustion engine 10 stops. This makes it possible to suppress the temperature rise in cylinder head 11 during idle reduction, and to prevent or reduce the occurrence of pre-ignition and knocking at the restart of internal combustion engine 10.

Moreover, in this embodiment, the cooling water having passed through quickly warmed-up cylinder head 11 can be supplied to the heater devices such as heater core 91. This allows for quicker startup of the heater.

In addition, even while internal combustion engine 10 stops, the heater can be operated by driving electric water pump 40 to supply the cooling water having passed through cylinder head 11 to the heater devices such as heater core 91.

Although the invention has been described in detail with reference to the preferred embodiment, it is apparent that the invention may be modified into various forms by one skilled in the art based on the fundamental technical concept and teachings of the invention.

For example, flow rate control valve 30 is not limited to a rotor type. Alternatively, there may alternatively be used a switching valve having a structure for allowing an electric actuator to linearly move its valve element.

Moreover, only heater core 91 may be disposed on fourth cooling water pipe 74. Alternatively, heater core 91 and any one or two of EGR cooler 92, exhaust gas recirculation control valve 93 and throttle valve 94 may be disposed on fourth cooling water pipe 74.

The passages connecting cooling water passage 62 for cylinder block 12 to cooling water passage 61 for cylinder head 11 do not have to be provided in the interior of internal combustion engine 10. Another piping configuration may be employed, instead. In an alternative piping configuration, an inlet of cooling water passage 62 is formed in cylinder block 12 and seventh cooling water pipe 77 branches into two pipes in the middle thereof. One of these branch pipes is connected to cooling water passage 61 while the other branch pipe is connected to cooling water passage 62.

Furthermore, water pump 40 may be driven by internal combustion engine 10.

When such a mechanically driven water pump 40 is used, the discharge rate of water pump 40 depends on the rotational speed of internal combustion engine 10. However, the distribution of the flow rate can be controlled by using flow rate control valve 30 in this case as well. Thus, even in this case, the quicker warm-up of cylinder head 11 and the quicker startup of the heater can be achieved, and cylinder head 11 and cylinder block 12 can be independently controlled at different temperatures.

In the cooling device, among the first to fourth cooling liquid lines, either or both of the third and fourth cooling liquid lines may be omitted.

Moreover, the cooling device may have a structure in which oil cooler 16 is not disposed on second cooling liquid line.

An auxiliary electric water pump may be disposed on the bypass line. A mechanically driven water pump, which is driven by internal combustion engine 10, may be provided in parallel to electric water pump 40.

REFERENCE SYMBOL LIST

10 Internal combustion engine
11 Cylinder head
12 Cylinder block
16 Oil cooler
20 Transmission (Power transmission device)
21 Oil warmer
30 Flow rate control valve
31 to 34 Inlet port
35 Outlet port
40 Water pump
50 Radiator
61 Cooling water passage
62 Cooling water passage
71 First cooling water pipe
72 Second cooling water pipe
73 Third cooling water pipe
74 Fourth cooling water pipe
75 Fifth cooling water pipe
76 Sixth cooling water pipe
77 Seventh cooling water pipe
78 Eighth cooling water pipe
81 First temperature sensor
82 Second temperature sensor
91 Heater core
92 EGR cooler
93 Exhaust gas recirculation control valve
94 Throttle valve
100 Electronic control device

The invention claimed is:

1. A cooling device for an internal combustion engine, comprising:

a water pump for circulating cooling liquid in the internal combustion engine;

a first cooling liquid line routed by way of a radiator and a cylinder head of the internal combustion engine;

a second cooling liquid line routed by way of a cylinder block of the internal combustion engine while bypassing the radiator;

a third cooling liquid line routed by way of the cylinder head and a heater core while bypassing the radiator;

a fourth cooling liquid line routed by way of the cylinder head and a power transmission device of the internal combustion engine while bypassing the radiator;

an electric flow rate control valve whose inlet is connected to the first cooling liquid line, the second cooling liquid line, the third cooling liquid line and the fourth cooling liquid line, and whose outlet is connected to an intake side of the water pump; and a bypass line that branches off from the first cooling liquid line at a point between the cylinder head and the radiator and that joins to the outlet of the flow rate control valve while bypassing the radiator.

2. The cooling device for the internal combustion engine according to claim 1, wherein the flow rate control valve has a position at which all the plurality of cooling liquid lines connected to the inlet are closed, a position at which the second cooling liquid line is opened while the other cooling liquid lines are closed, and a position at which all the plurality of cooling liquid lines connected to the inlet are opened.

3. The cooling device for the internal combustion engine according to claim 1, wherein the flow rate control valve has a position at which all the plurality of cooling liquid lines connected to the inlet are closed, a position at which the third cooling liquid line is opened while the other cooling liquid lines are closed, a position at which the third cooling liquid line and the second cooling liquid line are opened while the other cooling liquid lines are closed, and a position at which all the plurality of cooling liquid lines connected to the inlet are opened.

4. The cooling device for the internal combustion engine according to claim 1, wherein the flow rate control valve has a first position at which all the first to fourth cooling liquid lines are closed, a second position at which the third cooling liquid line is opened while the first cooling liquid line, the second cooling liquid line and the fourth cooling liquid line are closed, a third position at which the second cooling liquid line and the third cooling liquid line are opened while the first cooling liquid line and the fourth cooling liquid line are closed, a fourth position at which the second cooling liquid line, the third cooling liquid line and the fourth cooling liquid line are opened while the first cooling liquid line is closed, and a fifth position at which all the first to fourth cooling liquid lines are opened.

5. The cooling device for the internal combustion engine according to claim 4, further comprising a control unit for controlling the flow rate control valve, wherein the control unit sequentially changes a position of the flow rate control valve to the first position, the second position, the third position and the fourth position in this order, along with progression of warm-up of the internal combustion engine.

6. The cooling device for the internal combustion engine according to claim 1, further comprising:

a first temperature sensor for measuring a temperature of the cooling liquid at an outlet of the cylinder head; and a second temperature sensor for measuring a temperature of the cooling liquid at an outlet of the cylinder block.

7. The cooling device for the internal combustion engine according to claim 1, further comprising:

a first cooling water passage provided in the cylinder head; and a second cooling water passage branching off from the first cooling water passage so as to extend in the cylinder block.

8. The cooling device for the internal combustion engine according to claim 1, wherein the water pump is an electric water pump.

9. The cooling device for the internal combustion engine according to claim 1, further comprising a control unit for controlling the flow rate control valve, wherein, when a temperature of the cooling liquid at an outlet of the cylinder head is below a predetermined temperature, the control unit controls the flow rate control valve so as to set the flow rate control valve at a position at which all the lines connected to the inlet of the flow rate control valve are closed.

10. The cooling device for the internal combustion engine according to claim 1, further comprising a control unit for controlling the flow rate control valve, wherein, after a temperature of the cooling liquid at an outlet of the cylinder head reaches a predetermined temperature, the control unit controls the flow rate control valve so as to supply the cooling liquid to the third cooling liquid line.

11. The cooling device for the internal combustion engine according to claim 1, further comprising a control unit for controlling the flow rate control valve, wherein, after a temperature of the cooling liquid at an outlet of the cylinder block reaches a predetermined temperature, the control unit controls the flow rate control valve so as to supply the cooling liquid to the second cooling liquid line.

12. The cooling device for the internal combustion engine according to claim 1, further comprising a control unit for controlling the flow rate control valve, wherein the control unit controls the flow rate control valve so that a temperature of the cooling liquid at an outlet of the cylinder head becomes a first temperature, and so that a temperature of the cooling liquid at an outlet of the cylinder block becomes a second temperature higher than the first temperature.

13. The cooling device for the internal combustion engine according to claim 1, further comprising a control unit for controlling the water pump, wherein the water pump is an electric water pump, and the control unit increases a discharge flow rate of the electric water pump along with temperature rise in the cooling liquid at an outlet of the cylinder head.

14. The cooling device for the internal combustion engine according to claim 1, further comprising a control unit for controlling the water pump and the flow rate control valve, wherein the water pump is an electric water pump, and when the internal combustion engine temporarily stops, the control unit controls the flow rate control valve so as to supply the cooling liquid to the first cooling liquid line, and increases a discharge flow rate of the electric water pump.

* * * * *